US007789290B2

(12) United States Patent
Hsieh

(10) Patent No.: US 7,789,290 B2
(45) Date of Patent: Sep. 7, 2010

(54) PORTFOLIO

(75) Inventor: Li-Chuan Hsieh, Taipei (TW)

(73) Assignee: Foldermate Enterprise Co., Ltd., Taichung (TW)

( * ) Notice: Subject to any disclaimer, the term of this patent is extended or adjusted under 35 U.S.C. 154(b) by 323 days.

(21) Appl. No.: 11/863,245

(22) Filed: Sep. 27, 2007

(65) Prior Publication Data

US 2009/0084832 A1 Apr. 2, 2009

(51) Int. Cl.
*B65D 27/00* (2006.01)
*B65D 37/00* (2006.01)

(52) U.S. Cl. ..... 229/67.1; 229/67.4

(58) Field of Classification Search ..... 229/67.1–67.4, 229/928; 383/62; 206/816; 220/811, 812, 220/350

See application file for complete search history.

(56) References Cited

U.S. PATENT DOCUMENTS 3,494,637 A * 2/1970 Mason et al. ..... 281/45
5,271,502 A * 12/1993 Chang ..... 206/425
5,871,142 A * 2/1999 Josephson ..... 229/120.09
7,147,142 B1 * 12/2006 Chang ..... 229/67.3

* cited by examiner

*Primary Examiner*—Jes F Pascua

(57) ABSTRACT

A portfolio includes a body having a receiving space therein, a backside of the body having at least one sliding groove, an upper cover being a foldable sheet for sealing the receiving space; and a connecting unit passing through the sliding groove of the body and the upper cover so that the upper cover is slidable along the body. The connecting unit is a T rod and a washer; the T rod passes through a through hole of the upper cover and the sliding groove of the body, an enlarged end of the T rod resists against an upper side of the through hole; a size of the enlarged end of the T rod is greater than the size of the through hole and the sliding groove so that the T rod is retained upon the rear surface; and another end of the T rod is engaged with a washer.

7 Claims, 5 Drawing Sheets

PORTFOLIO

FIELD OF THE INVENTION

The present invention relates to portfolios, and particularly to a portfolio having a slidable upper cover so that the upper cover can be opened and wholly sliding downwards so as not to interfere the action of taking objects from the portfolio.

BACKGROUND OF THE INVENTION

In one prior art about portfolio is disclosed in U.S. Pat. No. 6,910,621, wherein an expanding file portfolio, comprising: a front panel member made from a substantially rigid plastic material; a rear panel member made from a substantially rigid plastic material; said rear panel member includes a front flap section, a rear panel section, and a connecting section extending between said front flap section and said rear panel section; and a spine member made from a substantially rigid plastic material; said spine member comprising a base section having a front edge and a rear edge; said front section of said spine member overlapping and attached to a portion of said front panel member and said rear section overlapping and attached to a portion of said rear panel section; said front flap section has an opening formed therein for receipt of a latch member associated with the front section of said spine member.

However, in the prior art portfolio, the cover of the portfolio is fixed to one side so that as the upper cover is opened, the cover will affect the action of the user in taking the object from the receiving space of the portfolio. Thus there is an eager demand for a novel design which can provides a cover as the cover is opened, it will not affect the action of the user in taking the objects from the portfolio.

SUMMARY OF THE INVENTION

Accordingly, the primary object of the present invention is to provide a portfolio having a slidable upper cover so that the upper cover can be opened and wholly sliding downwards so as not to interfere the action of taking objects from the portfolio.

To achieve above objects, the present invention provides a portfolio comprising: a body having a receiving space defined therein, a backside of the body having at least one sliding groove longitudinally defined therein; an upper cover is a foldable sheet for sealing the receiving space defined in the body; and at least one connecting unit passes through the sliding groove of the body and the upper cover so that the upper cover is slidable along the body. The at least one connecting unit includes a T rod and a washer; the T rod passes through a through hole defined in the upper cover and sliding groove of the body, an enlarged end of the T rod resists against an upper side of the through hole; a size of the enlarged end of the T rod is greater than a size of the through hole and the sliding groove so that the T rod is retained upon the rear surface; another end of the T rod is engaged with a washer and then a distal end protruding out from the washer is an expanding end so as to fix the washer to the upper cover. The body has a buckle and the upper cover has another buckle engageable to the buckle of the body so that the upper cover can be retained to the body; or the upper cover is formed with a male buckle and the body is formed with a female buckle for receiving the male buckle of the upper cover.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
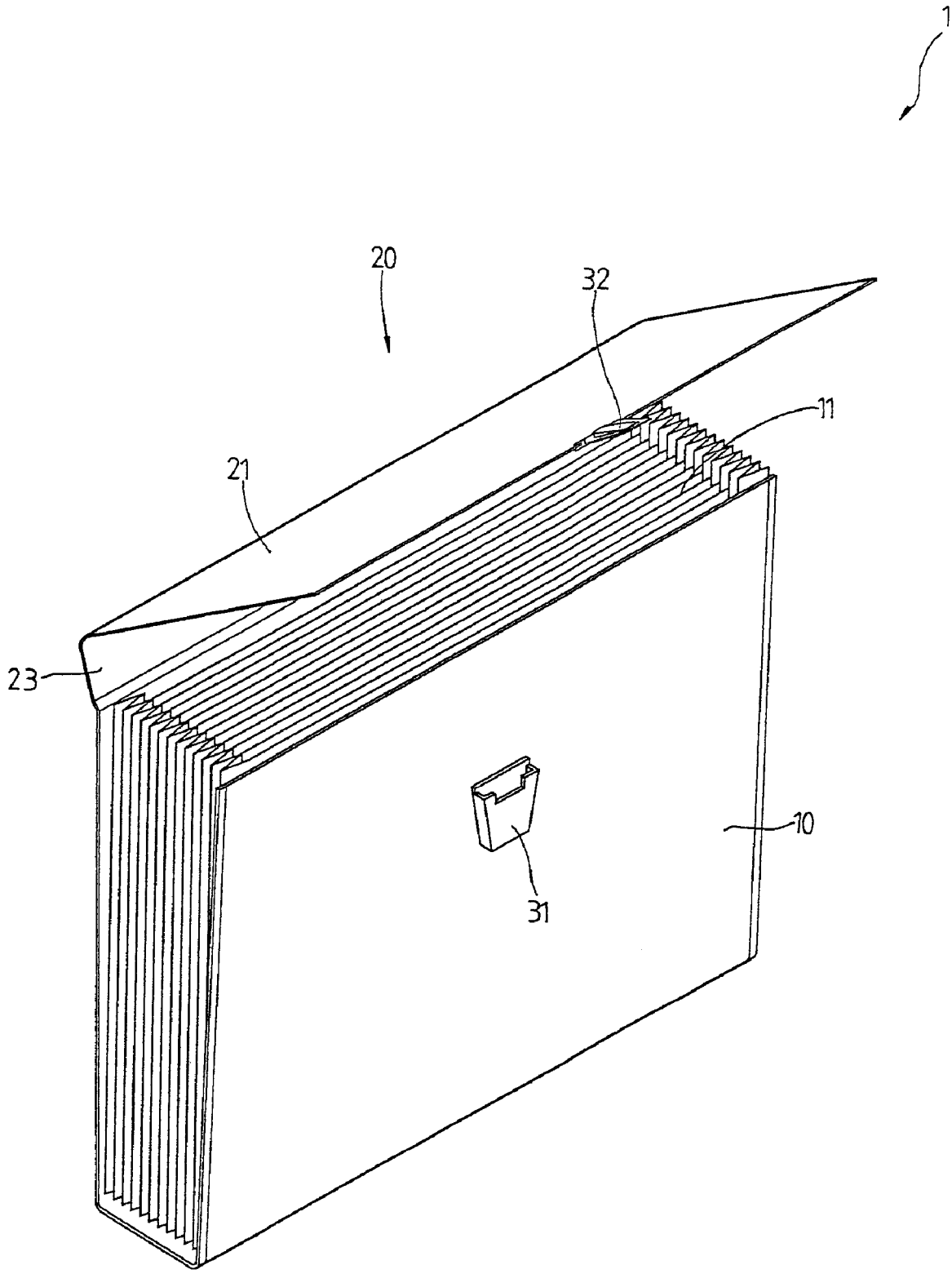
FIG. 1 is a perspective view of the portfolio of the present invention.
Figure 2:
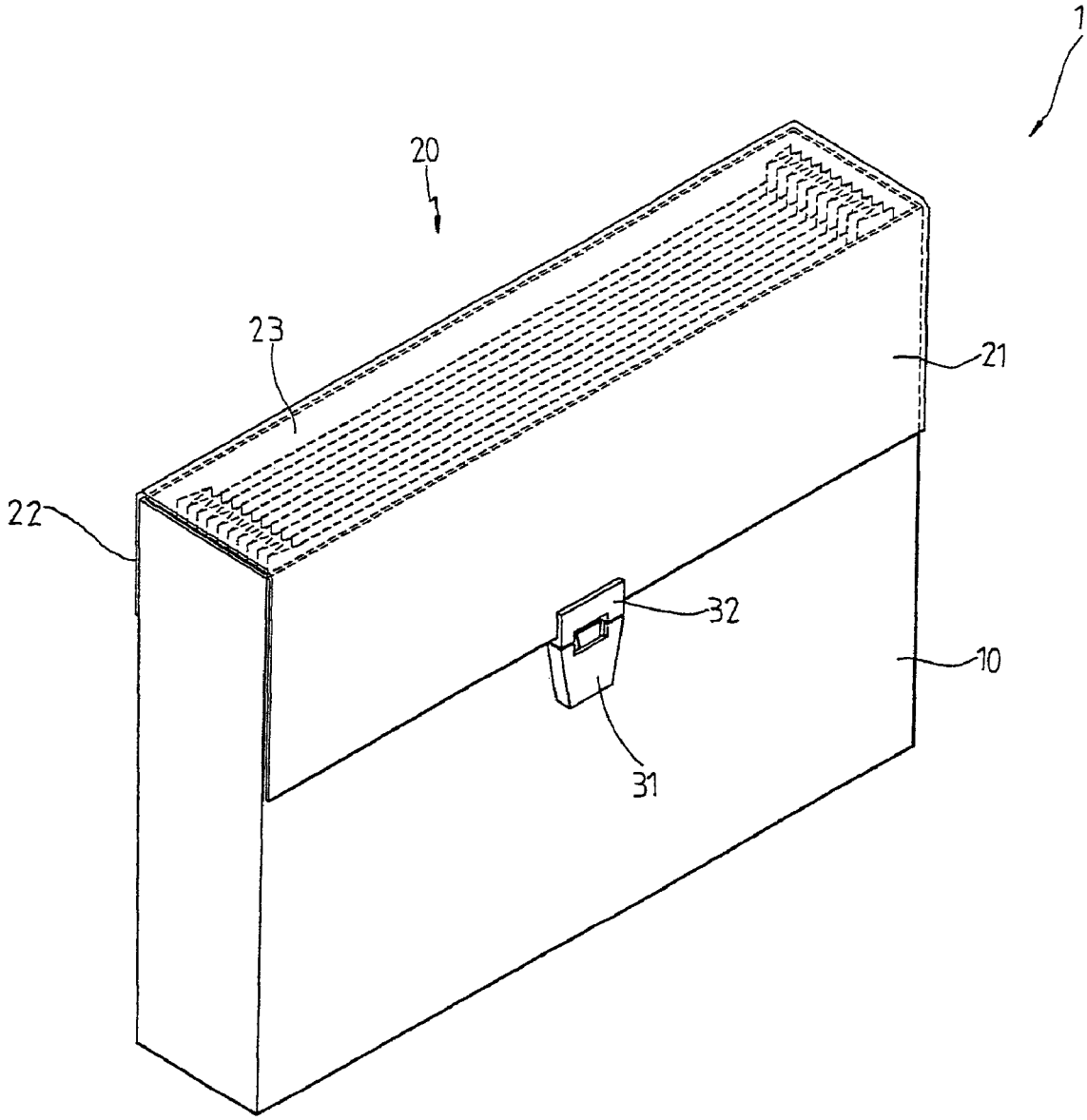
FIG. 2 is a front view of the portfolio of the present invention.
Figure 3:
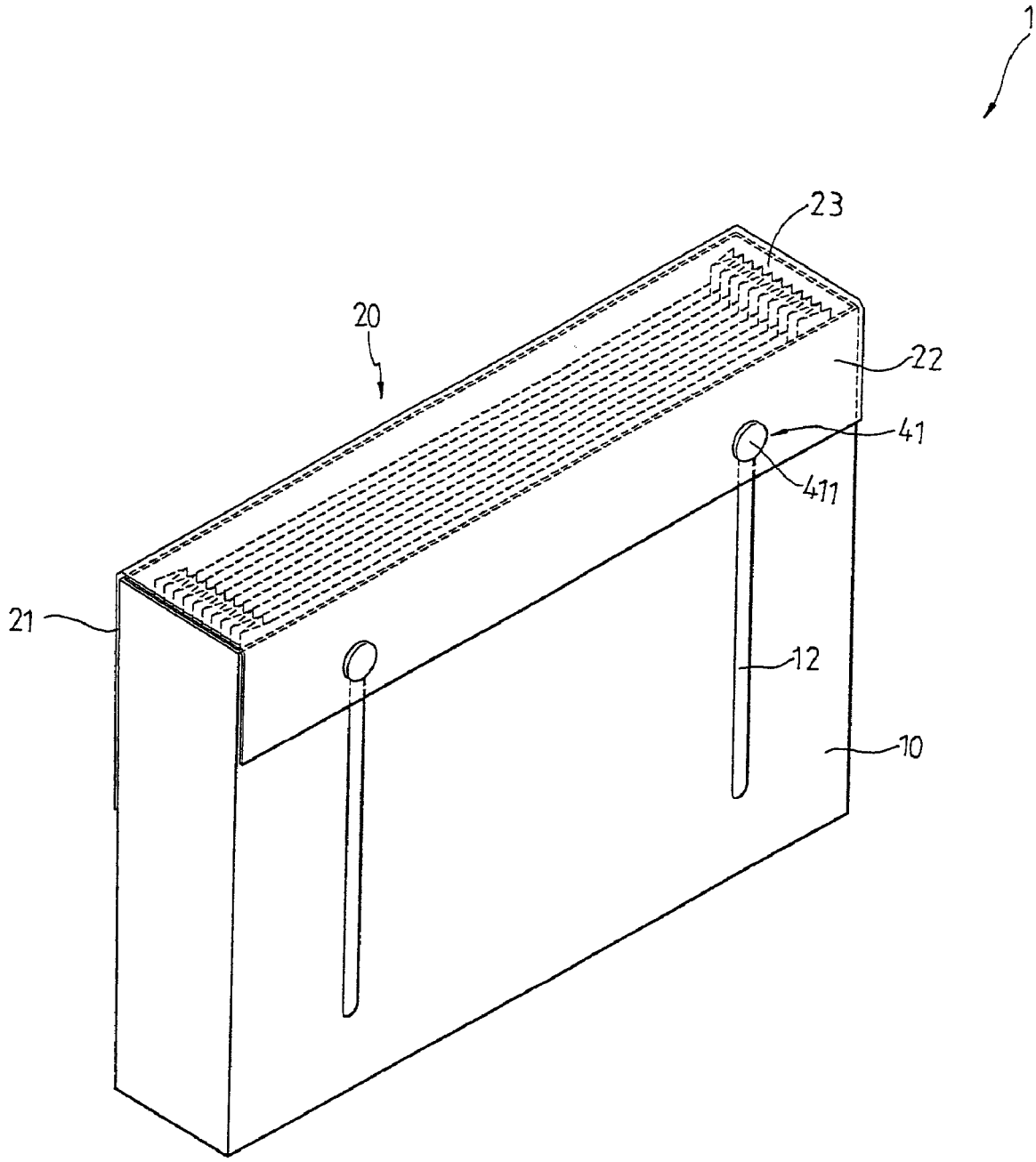
FIG. 3 is a rear perspective view of the portfolio of the present invention.

Referring to FIG. 1, the portfolio 1 of the present invention is illustrated. The present invention has the following elements.

A body 10 has a "⊔" shape structure with an opened top side. An interior of the body 10 is formed with a receiving space 11. The receiving space 11 may be a single space or includes a plurality of sub-spaces. Two sliding grooves 12 are longitudinally defined in a backside of the body 10.

An upper cover 20 is a foldable sheet which can be folded twice to have a front surface 21, a top surface 23 and a rear surface 22. The front surface 21 is formed with a male buckle 32 and the front surface 21 of the body 10 has a female buckle 31 for receiving the male buckle 32 of the upper cover 20. However, the front surface 21 of the upper cover 20 may be formed with a female buckle 31 and the front surface 21 of the body 10 may be formed with a male buckle 32. All these are within the scope of the present invention. The rear surface 22 has two through holes.

Figure 4:
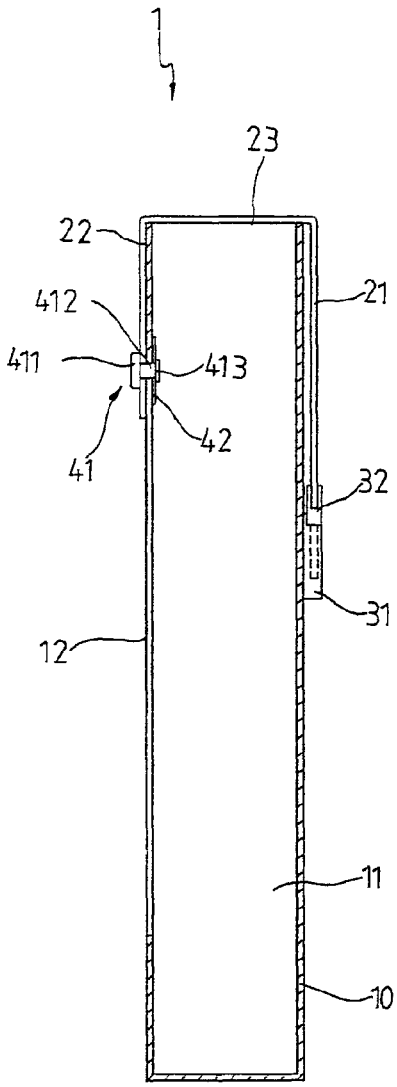
FIG. 4 is a schematic cross sectional view of the portfolio of the present invention.
Figure 5:
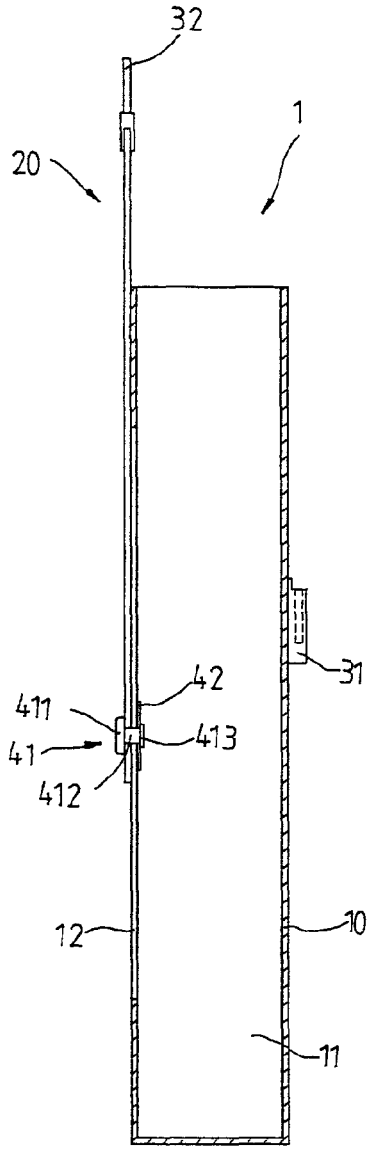
FIG. 5 is a schematic view showing the operation of the present invention.
Figure 6:
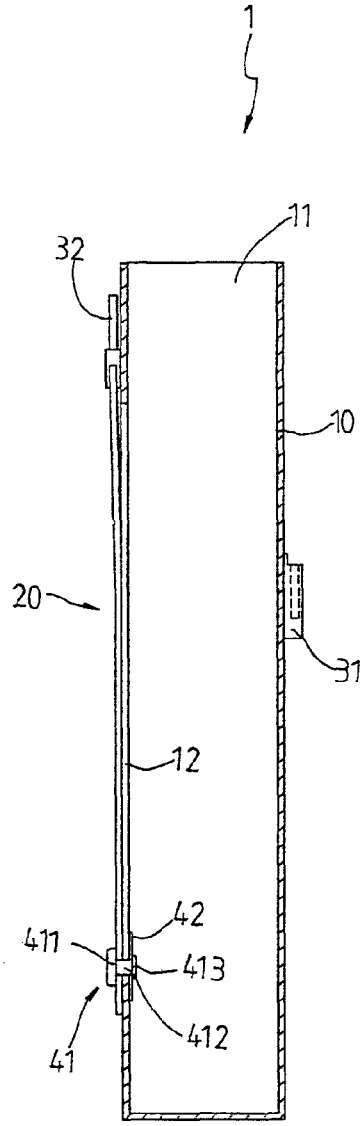
FIG. 6 is a schematic cross sectional view showing that the upper cover of the present invention is wholly expanded and is pulled downwards fully.

Referring to FIGS. 4 to 6, it is illustrated that a rod body 412 of a T rod 41 passes through the sliding groove 12 of the body 10 and the through hole on the rear surface 22 of the upper cover 20. An enlarged end 411 of the T rod 41 resists against an upper side of the through hole. A size of the enlarged end 411 of the T rod 41 is greater than the size of the through hole and the sliding groove 12 so that the T rod 41 is retained upon the rear surface 22. Another end of the T rod 41 is engaged with a washer 42 and then a distal end protruding out from the washer 42 is an expanding end 413 so as to fix the washer 42 to the upper cover 20.

Figure 7:
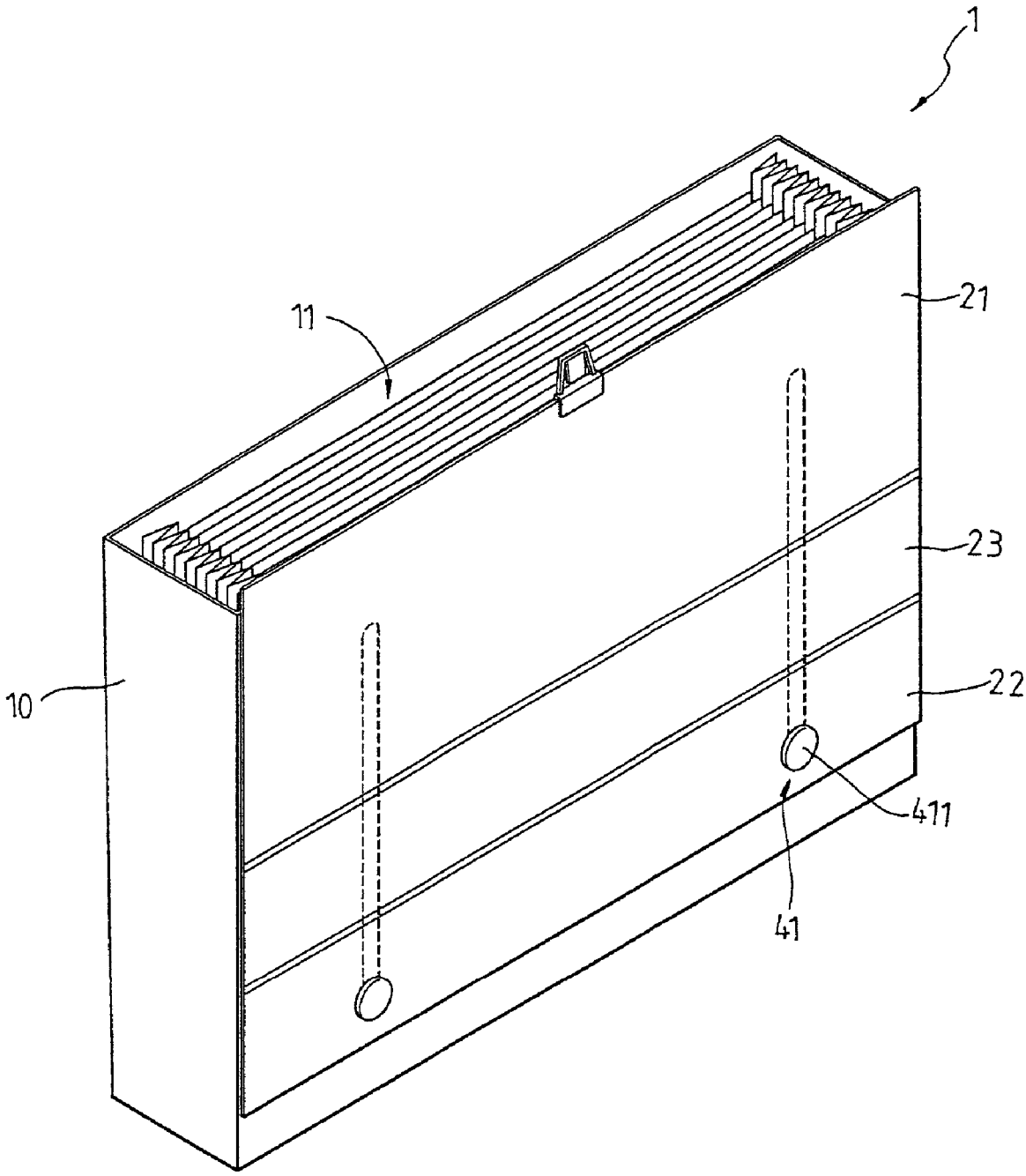
FIG. 7 is a perspective view of the portfolio in the state of FIG. 6.

Referring to FIGS. 4 to 6 and FIG. 7, the operation of the present invention is illustrated. In FIG. 5, it is illustrated that the upper cover 20 is unfolded so that the front surface 21, top surface 23 and rear surface 22 are as in a same plane, then the upper cover 20 is moved downwards along the backside of the body 10 by sliding the two T rods 41 along the two sliding grooves 12 to a state as illustrated in FIG. 6 and FIG. 7, such that the upper cover 20 is concealingly disposed on the backside of the body 10, thereby the receiving space 11 of the body 10 is completely unsealed; and thus the user may take the object in the portfolio 1 easily and freely without being affected and interfered by the foldable upper cover 20.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A portfolio comprising:

a body having a receiving space defined therein, a backside of the body having at least one sliding groove defined therein;

an upper cover being a foldable sheet for sealing the receiving space of the body; and at least one connecting unit each includes a T rod, the T rod simultaneously passing through the at least one sliding groove defined in the body and the upper cover so that the upper cover is slidable along the body via the T rod;

wherein when the upper cover is unfolded, the upper cover slidably moved downward along the backside of the body by sliding the T rod along the at least one sliding groove, such that the upper cover is concealingly disposed on the backside of the body to completely unseal the receiving space; and thus the user may take the object in the portfolio easily and freely without being affected and interfered by the foldable upper cover.

2. The portfolio as claimed in claim 1, wherein the body has two sliding grooves longitudinally defined therein.

3. The portfolio as claimed in claim 1, wherein the T rod has an enlarged end resisting against an upper side of a through hole; a size of the enlarged end of the T rod is greater than the size of the through hole and the sliding groove so that the T rod is retained upon the rear surface; another end of the T rod is engaged with a washer and then an distal end protruding from the washer is an expanding end so as to fix the washer to the upper cover.

4. The portfolio as claimed in claim 1, wherein the body has a buckle disposed thereon, and the upper cover has another buckle disposed thereon and engageable to the buckle disposed on the body so that the upper cover can be retained to the body.

5. The portfolio as claimed in claim 1, wherein the receiving space has a plurality of sub-spaces defined therein.

6. The portfolio as claimed in claim 1, wherein the upper cover is formed with a male buckle and the body is formed with a female buckle for receiving the male buckle of the upper cover.

7. The portfolio as claimed in claim 1, wherein the upper cover is formed with a female buckle and the body is formed with a male buckle for receiving the male buckle of the upper cover.

* * * * *